US007927667B2

(12) United States Patent
McEldowney et al.

(10) Patent No.: US 7,927,667 B2
(45) Date of Patent: Apr. 19, 2011

(54) SPRAY APPARATUS AND METHOD FOR THE REPAIR OF CAN ENDS

(75) Inventors: Craig Allan McEldowney, Russia, OH (US); Dennis Cornelius Stammen, Vandalia, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 78 days.

(21) Appl. No.: 12/574,330

(22) Filed: Oct. 6, 2009

(65) Prior Publication Data

US 2010/0021629 A1 Jan. 28, 2010

Related U.S. Application Data

(62) Division of application No. 11/376,357, filed on Mar. 15, 2006, now Pat. No. 7,622,002.

(51) Int. Cl.
*B05D 1/02* (2006.01)

(52) U.S. Cl. ..... 427/421.1; 118/308; 118/309; 118/323; 118/316; 118/306

(58) Field of Classification Search ..... 118/308, 118/309, 306, 317, 321, 323
See application file for complete search history.

(56) References Cited

U.S. PATENT DOCUMENTS 4,908,153 A * 3/1990 Kossmann et al. ..... 204/625
2003/0084929 A1 * 5/2003 Kamikawa et al. ..... 134/104.4

FOREIGN PATENT DOCUMENTS

EP 0933134 * 8/1999
GB 888768 * 2/1962

* cited by examiner

*Primary Examiner* — Timothy H Meeks
*Assistant Examiner* — Nathan T Leong
(74) *Attorney, Agent, or Firm* — Eckert Seamans Cherin & Mellott, LLC; Grant E. Coffield, Esquire

(57) ABSTRACT

This invention generally relates to a spray apparatus and a method useful in the repair of coating adhered to can ends used in the food and beverage packaging industries. The spray apparatus has one or more elongated shafts rotatably coupled to a frame. One or more bearing members are rotatably coupled to the shafts. One or more plates are rotatably coupled to the bearing members. One or more spray guns are coupled to the plates. The spray guns of the spray apparatus are structured to apply fluid to the can end with a solid stream emitted from the spray guns in a circular pattern. A method for the repair of coating adhered on a can end is provided as well.

18 Claims, 9 Drawing Sheets

SPRAY APPARATUS AND METHOD FOR THE REPAIR OF CAN ENDS

This application is a divisional of application Ser. No. 11/376,357, filed Mar. 15, 2006 now U.S. Pat. No. 7,622,002 and entitled "SPRAY APPARATUS AND METHOD FOR THE REPAIR OF CAN ENDS".

FIELD OF THE INVENTION

This invention generally relates to a spray apparatus and a method useful in the manufacture of can ends used in the food and beverage packaging industries. More specifically, the invention provides a spray apparatus and a method for use in the corrosion preventative repair of tooling induced damage to can end coatings, which may occur to coated steel can ends during the conversion of a steel shell into a full open or easy open food or beverage can end.

BACKGROUND OF THE INVENTION

Many can bodies for food, beverages or other products are provided with easy open can ends that are characterized by having a pull tab attached to the can end which is used to fracture a tear panel on the can end defined by a score line on the can end. The pull tab may be lifted to depress the tear panel in order to provide an opening in the can end for dispensing the contents of the container.

Likewise, many food products are sold in can bodies provided with full open easy open can ends that are characterized by having a pull tab attached to the can end which is used to fracture a score line that circumscribes the circumference of the end panel to define an opening panel. The pull tab may be lifted to fracture the score line. After the score line is fractured, the pull tab may be pulled upward from the container which severs the remainder of the score line in order to remove the entire opening panel for dispensing the contents of the container.

In the manufacture of an easy open can end, a shell is conveyed to a conversion press. In the industry, a pre-converted can end is commonly referred to as a shell. In the typical operation of a conversion press, a shell is introduced between an upper tool member and a lower tool member, which are in the open, spaced apart position. A press ram advances the upper tool member toward the lower tool member in order to perform any of a variety of tooling operations such as rivet forming, paneling, scoring, embossing, and final staking. After performing a tooling operation, the press ram retracts until the upper tool member and lower tool member are once again in the open, spaced apart position. The partially converted shell is transported to the next successive tooling operation until an easy open can end is completely formed and discharged from the press. As one shell leaves a given tooling operation, another shell is introduced to the vacated operation, thus continuously repeating the entire easy open can end manufacturing process. Examples of easy open can ends can be found in U.S. Pat. Nos. 4,465,204 and 4,530,631. Conversion presses can operate at speeds that manufacture in excess of 500 can ends per minute per lane, with certain presses having four lanes of tooling manufacturing in excess of 2000 converted can ends per minute.

It has been the practice in the industry to continue to strive to reduce the starting gauge of the metal sheet stock used to form the can end. The current practice is to use metal with a starting gauge of approximately 0.008 inch (0.20 mm). As such, tooling stations in a conversion press must be rigorously maintained within prescribed operating tolerances due to the thin sheet stock used in the press. In the production of a converted can end in a conversion press, the scoring station is of particular concern. The scoring station employs a tooling member that has a knife edge which defines the tear panel or opening panel on the public side of the can end.

Steel sheet stock used in the manufacture of can ends has a coating which protects the metal by inhibiting oxidation, corrosion or rust from forming on the surface of the metal. During the conversion process, damage to the protective coating typically occurs while forming the score that defines the tear panel or opening panel of the can end. As noted above, in the conversion of a shell into a can end with openable features thereon, a score line is formed. This score line defines the tear panel or opening panel described above. The score line is the most likely location where damage is caused to the pre-conversion, protective coating. Any oxidation, corrosion or rust on the surface of the can end represents an unattractive product appearance to the consumer and is unacceptable to canmakers in general.

In the industry, as a precautionary measure to prevent oxidation, corrosion or rust from appearing on the can end, many canmakers apply a fluid, repair fluid, lacquer or paint to the scored area of the can end by spraying the can end. The accepted spraying apparatus and method in the industry for score repair on full open easy open ends utilizes high pressure spray atomization which forms small droplets or particles of fluid, repair fluid, lacquer or paint from the fluid, repair fluid, lacquer or paint. Atomization can be achieved by high pressure impingement (between 100 psi (0.690 MPa) to 600 psi (4.137 MPa)) on an orifice of a spray head or using a secondary low pressure air source (around 100 psi (0.690 MPa)) to break the fluid into small controlled droplets or particles. The problem with the atomization method is that it generates overspray which is detrimental to the efficiencies of the machine due to the extensive cleaning required on the surrounding transfer mechanism or belt of the machine. Overspray is defined herein as the additional fluid, repair fluid, lacquer or paint that does not transfer directly to the can end and sprays beyond the scored surface of the can end onto the transfer mechanism, belt or machine. The two part epoxy coating mixtures commonly used as a fluid is difficult to manage on a continuously operating machine when overspray occurs because the fluid, repair fluid, lacquer or paint builds up on the surrounding transfer mechanism of the machine, and requires routine cleaning and maintenance to keep the machine running efficiently.

The present invention implements a low pressure solid stream spray head and method, which significantly reduces spray beyond the scored surface of the can end and allows for greater machine efficiencies due to reduced downtime associated with routine cleaning and maintenance. The solid stream nozzle provides prolonged stream integrity, which results in delayed breakup and drop formation after leaving the nozzle orifice. The fluid is essentially extruded in a continuous stream as opposed to a pattern of droplets or particles.

In certain humid environments where oxidation and corrosion are of greater concern than in less humid environments, many canmakers apply more fluid, repair fluid, lacquer or paint to the can end to prevent rust from appearing on the can end. The present low pressure non-atomization or solid stream spray head and method allows for a low and high film weight (up to 20 mg or more) to be applied on the can end without the heavy overspray associated with prior art high pressure atomized or droplet spray head repair systems. The industry accepted high pressure atomization or droplet spray head applies a lower film weight (around 10 mg) on a can end by providing a very thin layer of fluid, repair fluid, lacquer or paint coating at high pressure. Even at this reduced film weight, the industry accepted atomization spray head presents overspray problems. Also, the prior art atomized spray head does not apply enough film weight to the can ends in certain environments and contaminates the transfer mechanism, belt or machine because of overspray.

There continues to be a need in the art for a spray apparatus and method for the repair of can ends that can apply low and high film weights to the can ends than was previously known in the art. Additionally, there continues to be a need in the art for a spray apparatus and method that does not generate a high volume of overspray or substantially avoids overspray.

SUMMARY OF THE INVENTION

It is an object of the present invention to provide a spray apparatus and method for the repair of can ends that can apply low and high film weights to a can end. It is another object of the present invention to provide a spray apparatus and method for the repair of can ends that does not generate a high volume of overspray or substantially avoids overspray.

Certain objects of the present invention are obtained by providing a spray apparatus for the repair of coating adhered on a can end. The spray apparatus has one or more elongated shafts rotatably coupled to a frame. One or more bearing members are rotatably coupled to the shafts. One or more plates are rotatably coupled to the bearing members. One or more spray guns are coupled to the plates. The spray guns of the spray apparatus are structured to apply fluid to the can end with a solid stream emitted from the spray guns in a circular pattern.

Other objects of the present invention are obtained by providing a spray apparatus for the repair of coating adhered on a plurality of can ends. The spray apparatus has a frame and an elongated first shaft rotatably coupled to the frame. An elongated second shaft is rotatably coupled to the frame. A third shaft is coupled to the first shaft which passes through an aperture in a first bearing member and a first plate. A fourth shaft is coupled to the second shaft which passes through an aperture in a second bearing member and the first plate. A fifth shaft is coupled to the third shaft which passes through an aperture of a third bearing member and a second plate. A sixth shaft is coupled to the fourth shaft which passes through an aperture in a fourth bearing member and the second plate. A first bracket is coupled to the first plate and a second bracket is coupled to the second plate. A first spray gun is coupled to the first bracket and a second spray gun is coupled to the second bracket. The spray guns of the spray apparatus are structured to apply fluid to the can ends with a solid stream emitted from the spray guns in a circular pattern.

Other objects of the present invention are obtained by providing a method for the repair of coating adhered on a can end. The method comprises: supplying fluid to a low pressure tank; filtering the fluid through a fluid filter; flowing the fluid through a fluid flow sensor; and dispensing the fluid from a nozzle in a solid stream and in a circular pattern toward the can end. The low pressure tank, the fluid filter, the fluid flow sensor and the nozzle are in fluid communication with one another and define a fluid delivery system.

DETAILED DESCRIPTION OF THE PREFERRED EMBODIMENTS

Figure 1:
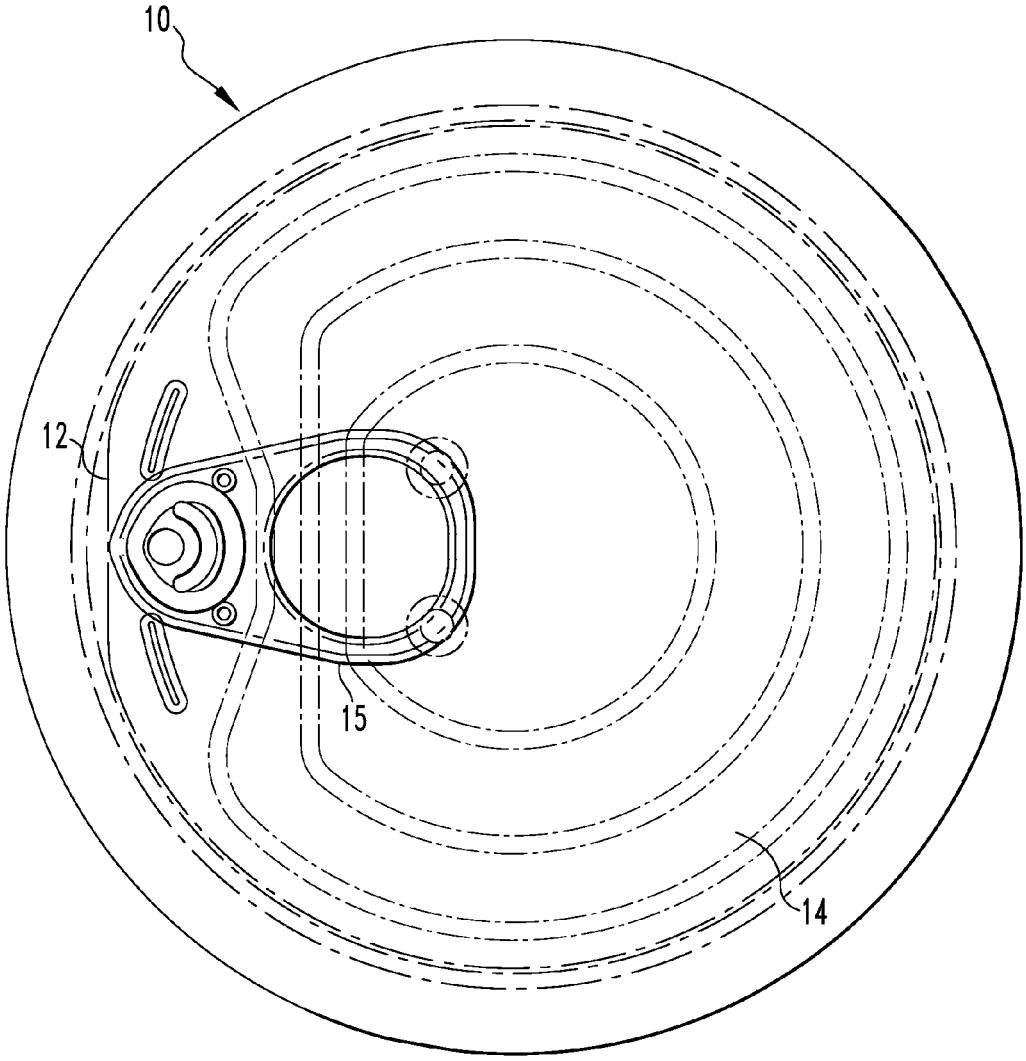
FIG. 1 is a top plan view of a full open easy opening end.

For purposes of the description hereinafter, the terms "upper", "lower", "vertical", "horizontal", "top", "bottom", "aft", "behind", "forward", "rear", "beneath", "below" and derivatives thereof shall relate to the invention, as it is oriented in the drawing FIGS. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

As employed herein, the term "number" refers to one or more than one (i.e., a plurality). As employed herein, the term "fastener" refers to any suitable fastening, connecting or tightening mechanism expressly including, but not limited to, integral rivets. As employed herein, the statement that two or more parts are "coupled", "attached" or "connected" together shall mean that the parts are joined together either directly or joined through one ore more intermediate parts.

Turning to FIG. 1, a full open easy open can end 10 is displayed. The can end 10 has a score line 12 which defines an opening panel 14. A pull tab 15 may be lifted to fracture the score line 12. After the score line 12 is fractured, the pull tab 15 may be pulled upward from the container which severs the remainder of the score line 12 in order to remove the entire opening panel 14 for dispensing the contents of the container.

Figure 2:
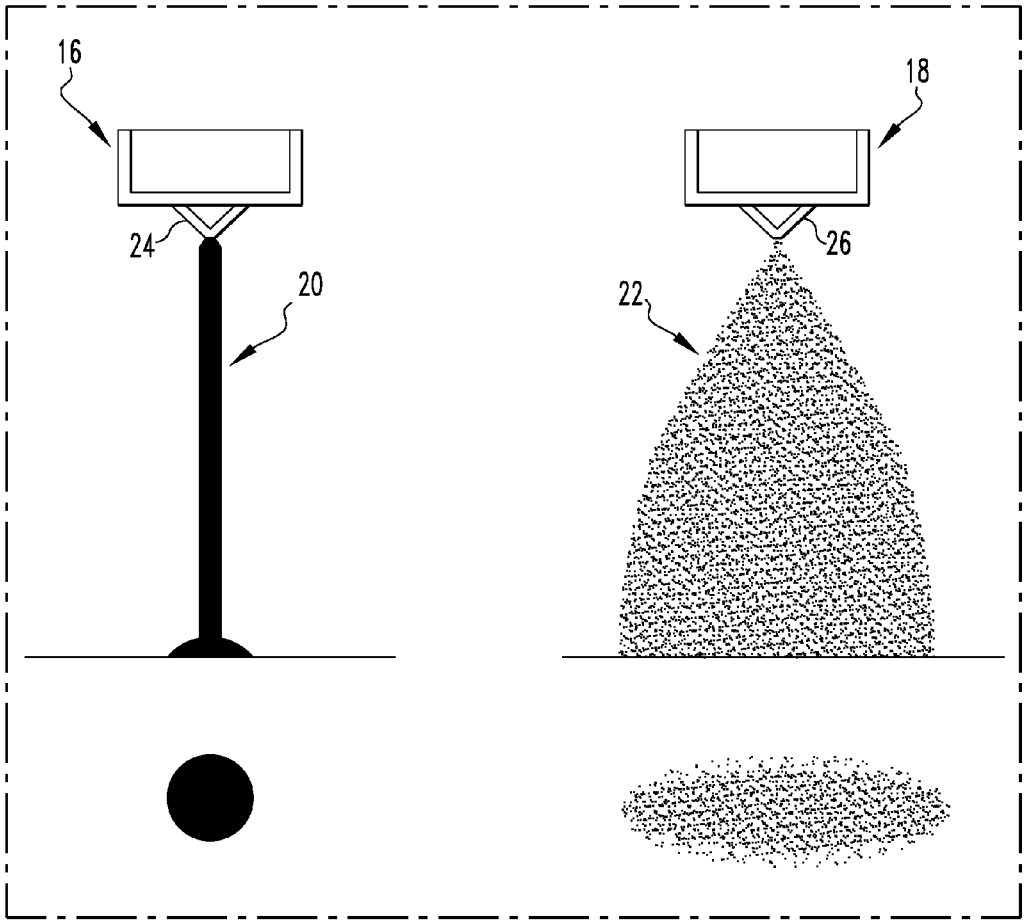
FIG. 2 is a schematic drawing of a low pressure solid stream or non-atomization spray head and a high pressure droplet or atomization spray head fan patterns.

Turning to FIG. 2, fan patterns emitted from a low pressure solid stream or non-atomization spray head 16 and a high pressure droplet or atomization spray head 18 are displayed. As can be seen, the fan pattern 20 of the spray head 16 is circular and concentrated whereas the fan pattern 22 of the spray head 18 is elliptical and disperse. The spray head 16 uses a solid stream nozzle 24 at a relatively low pressure of less than 100 psi (0.690 Mpa) from a compressed gas source or the like. The length that the fluid leaves the nozzle 24 allows for a continuous circular vector of fluid without turbulence or fluid breakup as it leaves the nozzle 24. Conversely, spray head 18 disperses an elliptical pattern of fluid in droplet form as it leaves nozzle 26. The emission of the fluid from spray head 16 in a solid stream and in a circular pattern allows the fluid to be sprayed on the score line 12 of the can end 10 in higher volumes and minimizes overspray onto a transfer mechanism or belt that negatively effects the machine efficiency equipped with spray head 18 due to the elliptical fan pattern 22.

Figure 3:
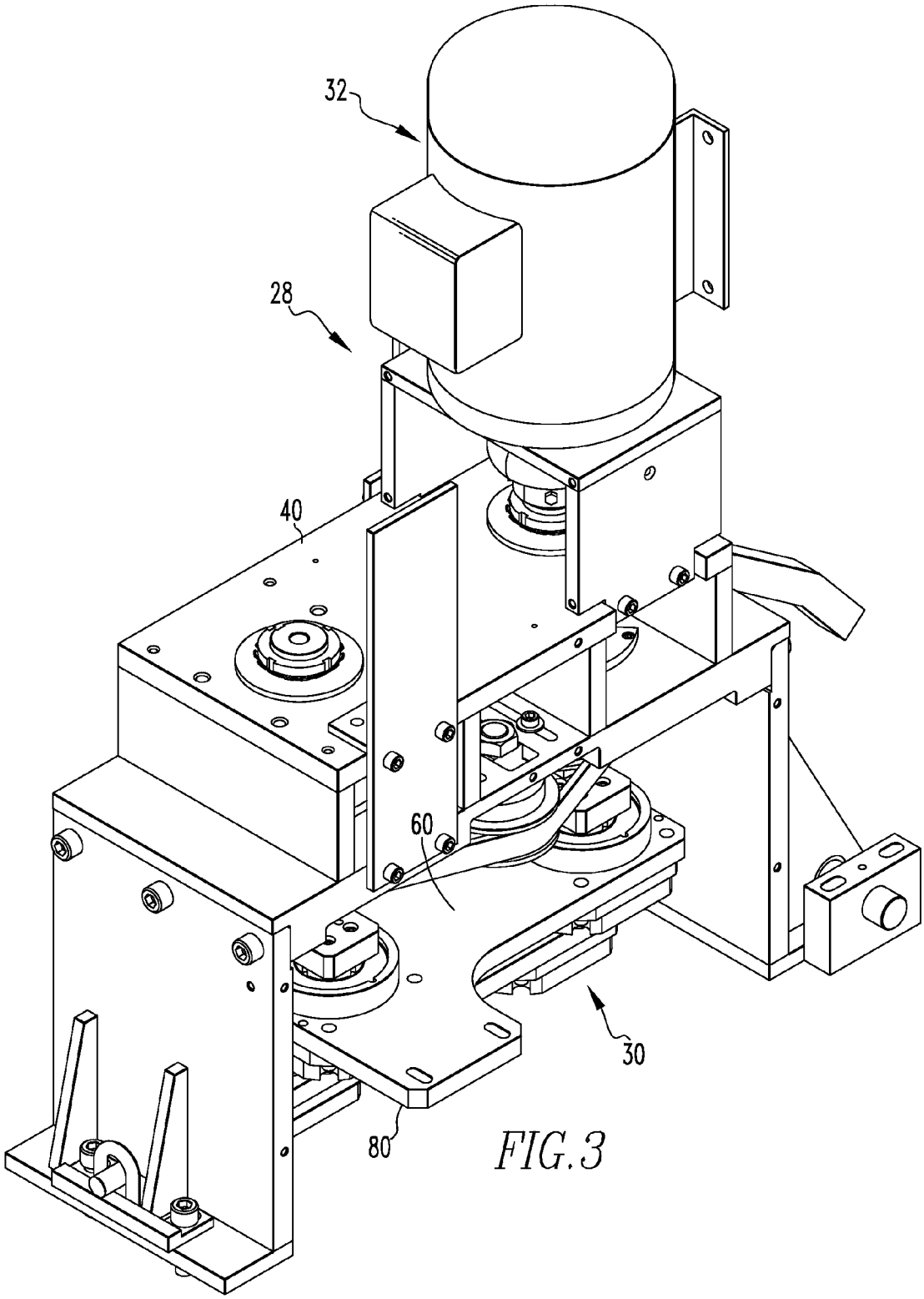
FIG. 3 is an isometric view of a spray head assembly.

The spraying method of spray head 16 is performed with low pressure on a translating or rotating spray head assembly 28 shown in FIG. 3. The spray path of the spray head assembly 28 is in a controlled manner if a solid stream spraying technique is employed. The spray head assembly 28 is dynamically balanced with a rigid bearing support mechanism 30 shown in FIGS. 4-5. The rigid bearing support mechanism 30 allows for accurate dispensing of the fluid to the can end 10 located in the transfer mechanism or belt located below the spray head assembly 28, a spray gun 82 and the nozzle 24. The solid stream method requires an accurate rotating assembly to control the spray location of the fluid. The bearing support mechanism 30 assists in controlling the rotating path of the spray head assembly 28.

Figure 4:
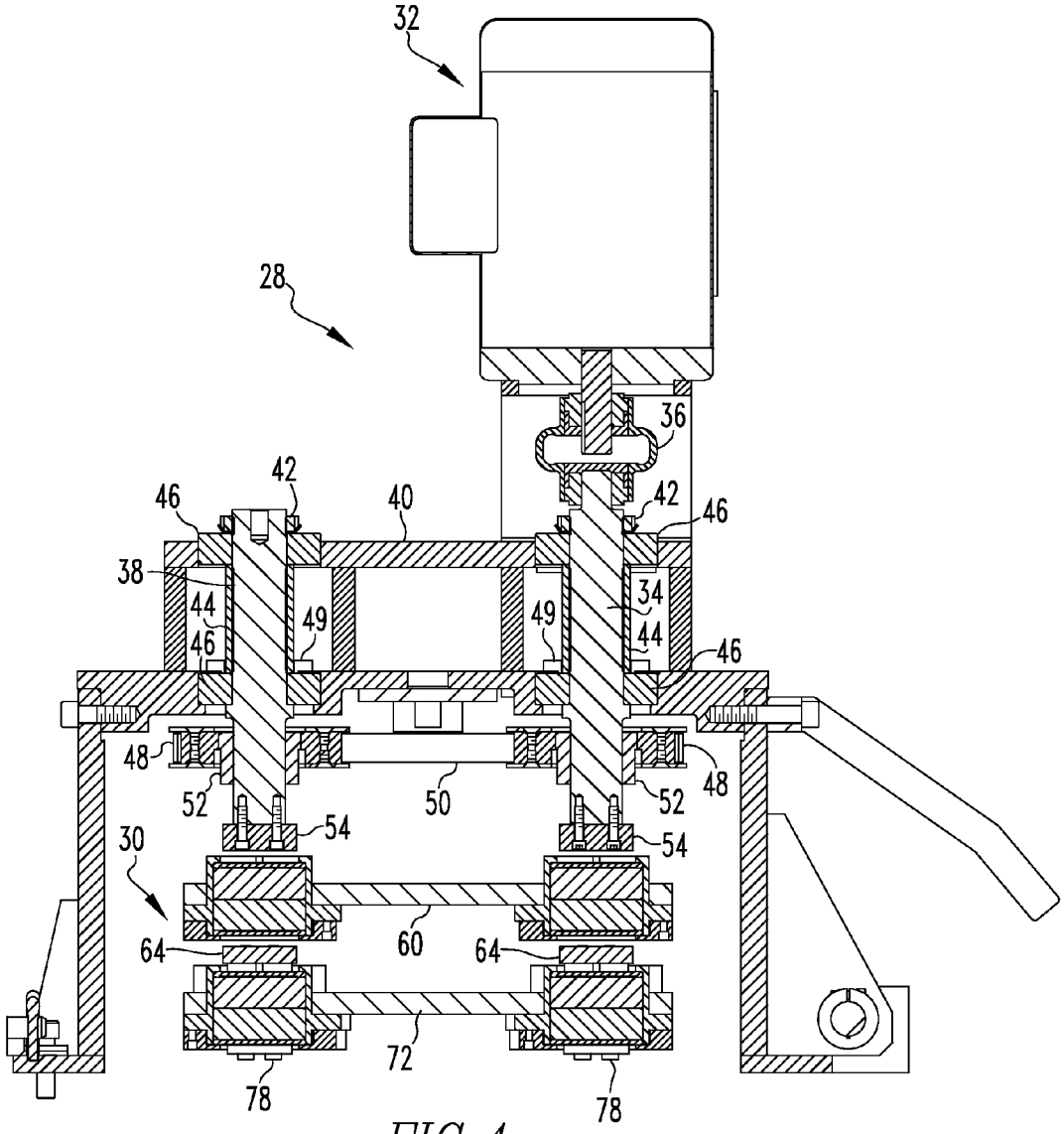
FIG. 4 is a side cross-sectional view of a spray head assembly.
Figure 6:
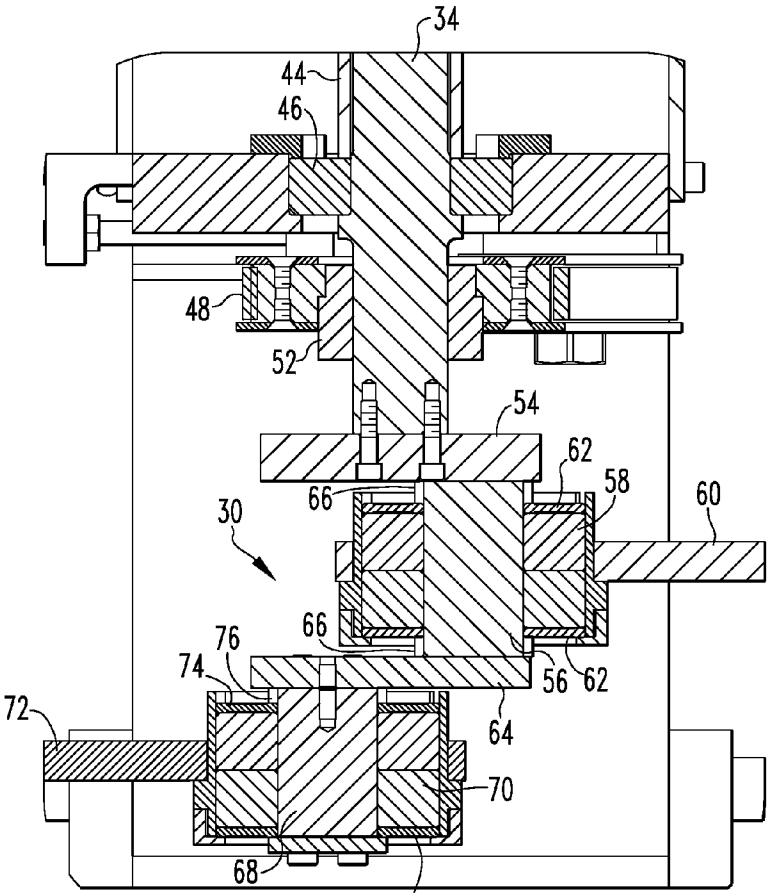
FIG. 6 is a detailed side cross-sectional view of a bearing support mechanism taken generally in the area of circle 6 in FIG. 5.
Figure 5:
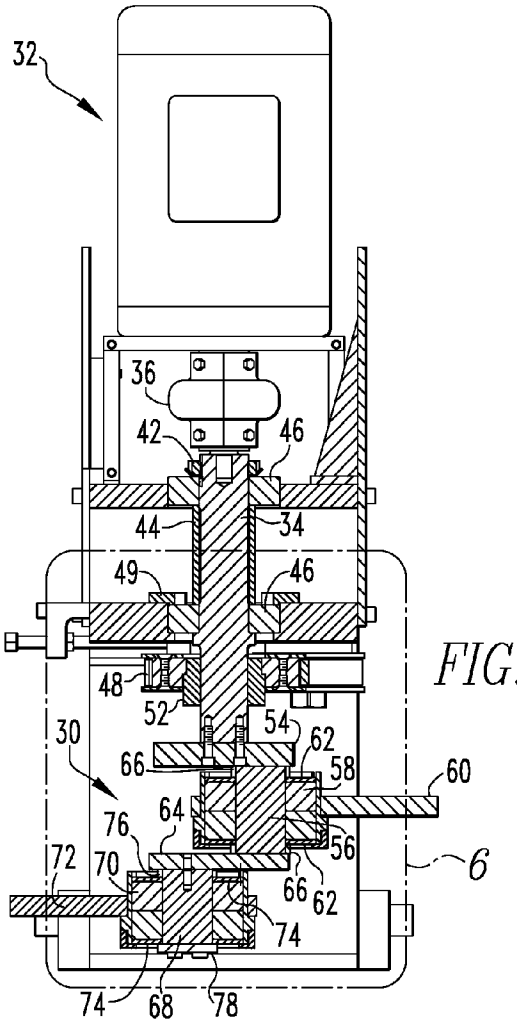
FIG. 5 is a side cross-sectional view of a bearing support mechanism.

As can be seen in FIGS. 4-5, the bearing support mechanism 30 is rotatably coupled to a motor 32 by an elongated first shaft 34 coupled to a coupling member 36 and a frame 40. With reference to FIG. 4, an elongated second shaft 38 is rotatably coupled to the frame 40. Each of the shafts 34, 38 are rotatably coupled to the frame 40 with one of a plurality of connectors 42. Each of the shafts 34, 38 passes through either a first or a second tubular spacer 44, a portion of a plurality of bearing members 46 coupled to the frame 40 and an aperture of either a first or a second sprocket 48. Bearing members 46 could be ball bearings, ball thrust bearings, flange bearings, needle bearings, preloaded bearings, roller bearings, roller thrust bearings, split sleeves, tapered roller bearings and other types of bearing members that are known in the art. The connectors 42 assist in keeping the upper bearing members 46 in place. Connectors 49 assist in keeping the lower bearing members 46 in place. Rotary motion applied by the motor 32 to shaft 34 is translated to shaft 38 by a belt 50 rotatably coupled to the sprockets 48. Sprockets 48 are spaced from shafts 34, 38 by spacing members 52 which have apertures through which one of the shafts 34, 38 pass. Mounting plates 54 are coupled to one or the other of the shafts 34, 38.

One end of each eccentric third and fourth shafts 56 are coupled to one or the other of mounting plates 54 and one or the other of the shafts 34, 38. Each of shafts 56 passes through an aperture of either a first or a second bearing member 58. Bearing members 58 could be ball bearings, ball thrust bearings, flange bearings, needle bearings, preloaded bearings, roller bearings, roller thrust bearings, split sleeves, tapered roller bearings and other types of bearing members that are known in the art. Bearing members 58 pass through apertures of first plate 60 and are encased within rings 62 which may be, by way of example and not limitation, sealing rings. Plate 60 is rotatably coupled to bearing members 58. The other end of each eccentric third and fourth shafts 56 are coupled to one or the other plate 64. Each of the bearing members 58 are spaced apart from the plates 54, 64 by a certain number of spacing members 66. Each plate 64 is also coupled to one or the other of fifth and sixth eccentric shafts 68 which are coupled to one or the other of third and fourth shafts 56. Each of shafts 68 pass through an aperture of either a third or a fourth bearing member 70. Bearing members 70 could be ball bearings, ball thrust bearings, flange bearings, needle bearings, preloaded bearings, roller bearings, roller thrust bearings, split sleeves, tapered roller bearings and other types of bearing members that are known in the art. Bearing members 70 pass through apertures of second plate 72 and are encased within rings 74 which may be, by way of example and not limitation, sealing rings. Plate 72 is rotatably coupled to bearing members 70. Each of the bearing members 70 are spaced apart from the plate 72 by a certain number of spacing members 76. A cap 78 is coupled to each of the shafts 68 to assist in keeping the bearing members 70 in place.

Figure 7:
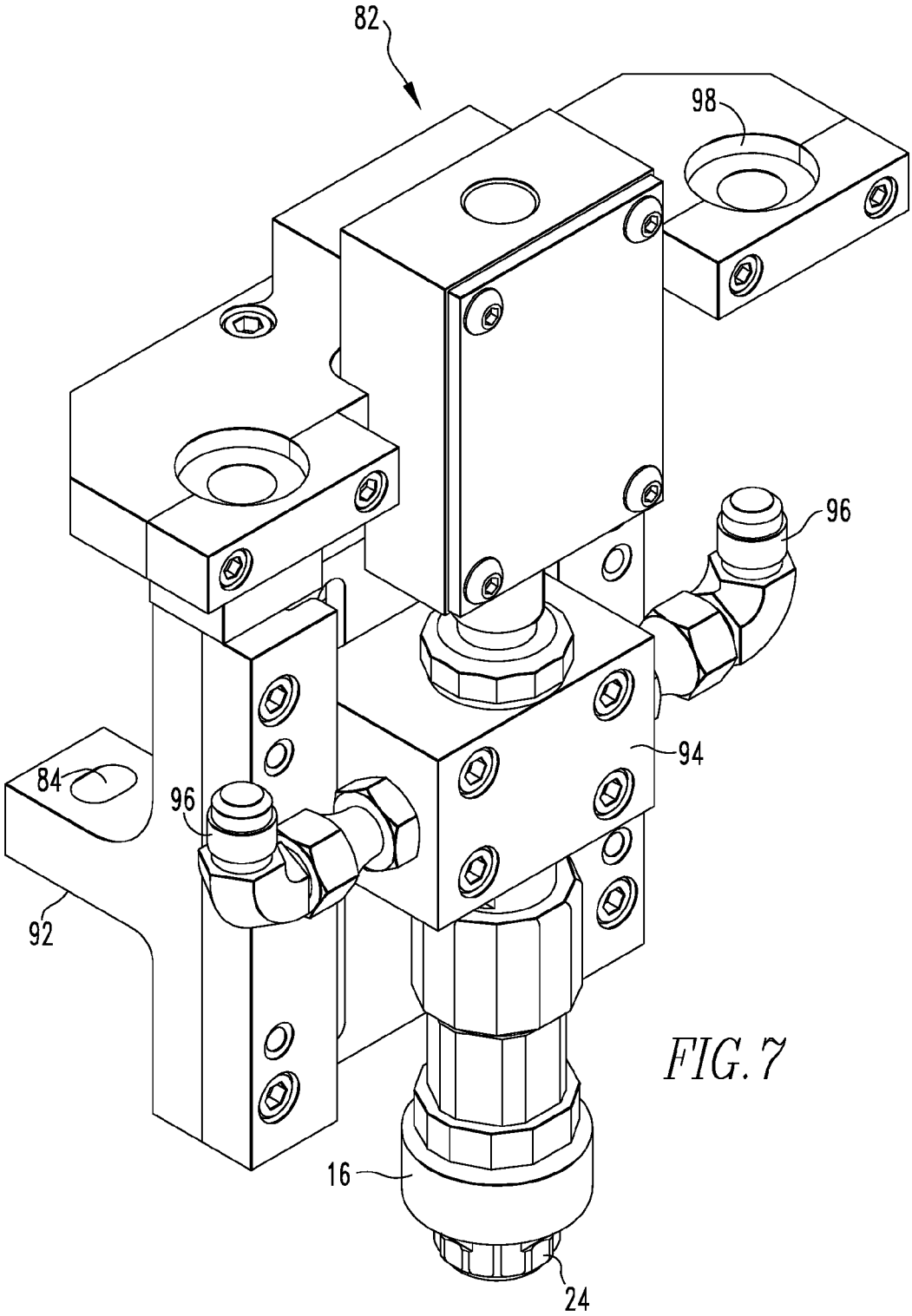
FIG. 7 is an isometric view of a spray gun.
Figure 8:
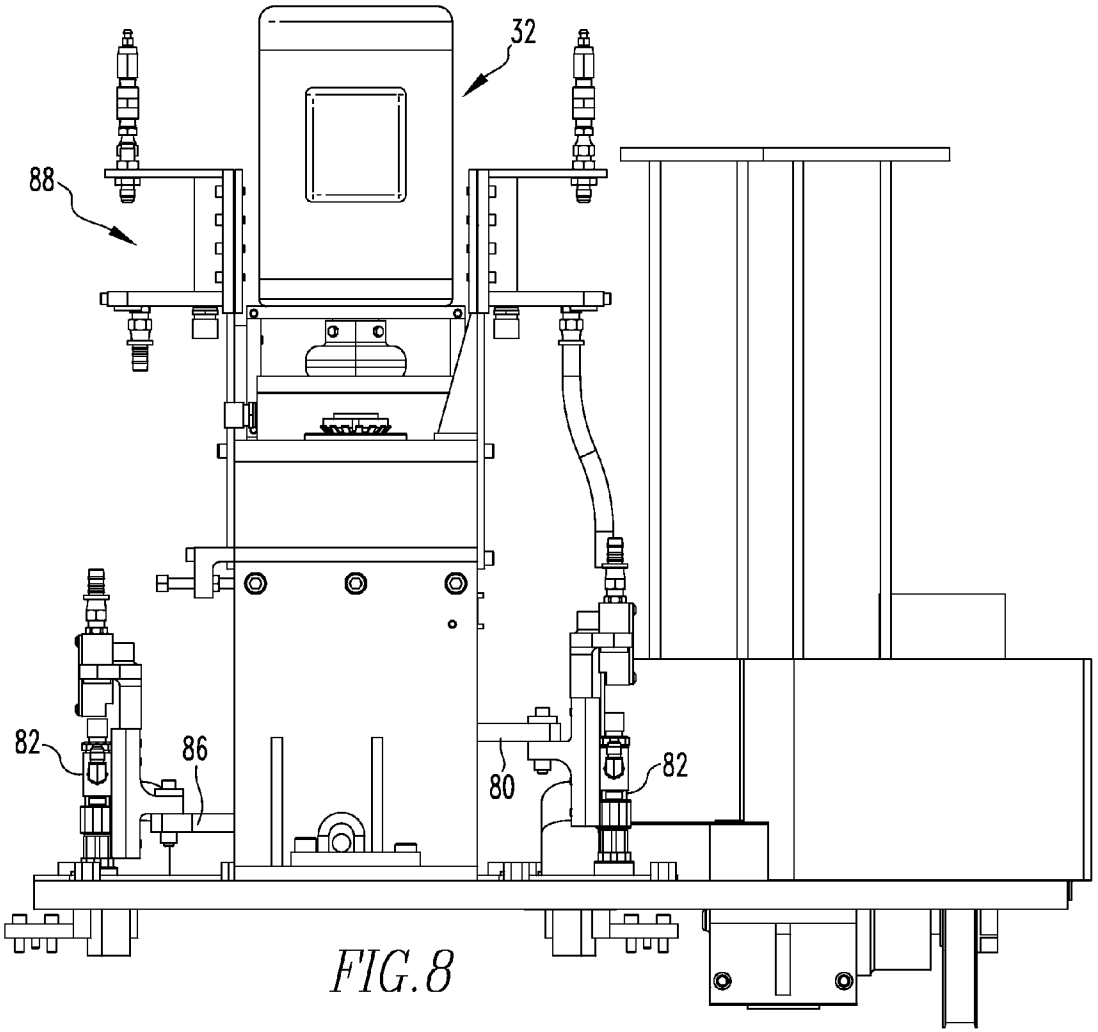
FIG. 8 is a side view of a spray machine.
Figure 9:
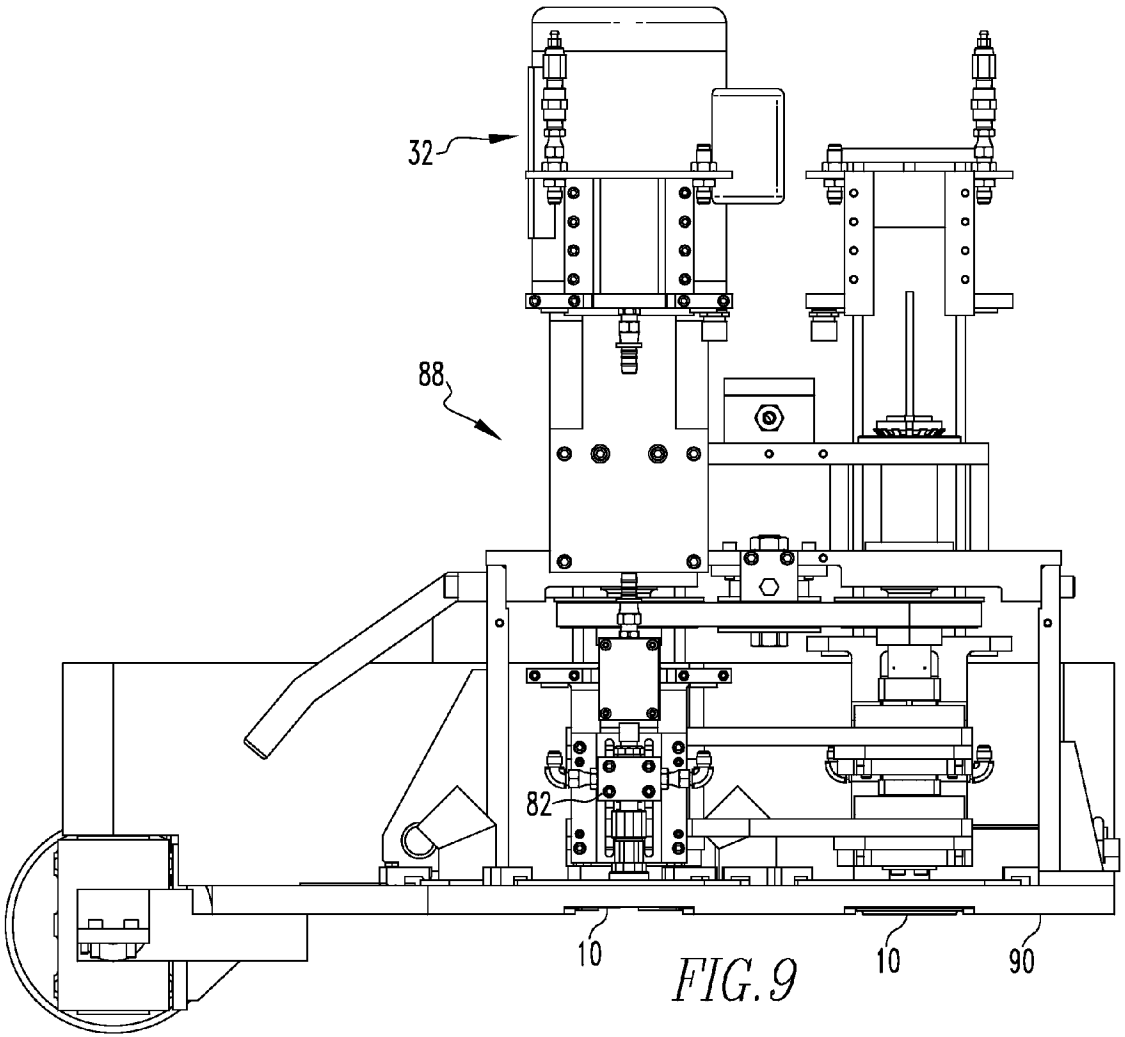
FIG. 9 is a side view of a spray machine.

With reference to FIG. 3, plate 60 has a mounting bracket 80 for securing a spray gun 82 of the type shown in FIG. 7. Spray gun 82 has a low pressure solid stream or non-atomization spray head 16 and nozzle 24. Of course, one could attach a high pressure droplet or atomization spray head 18 to the mounting bracket 80 as well. The spray gun 82 has a plurality of apertures 84 for coupling the spray gun 82 to the mounting bracket 80. FIG. 8 shows the spray gun 82 coupled to bracket 80. Various hoses that supply fluid to the spray gun 82 have been omitted from FIG. 8 for the purpose of simplifying FIG. 8. Likewise, plate 72 has a mounting bracket 86 for securing a spray gun 82 of the type shown in FIG. 7. Of course, one could attach a high pressure droplet or atomization spray head 18 to the mounting bracket 86 as well. FIG. 8 shows the spray gun 82 coupled to bracket 86. FIG. 9 shows the spray guns 82 connected to a spray machine 88. As in FIG. 8, various hoses that supply fluid to the spray gun 82 have been omitted from FIG. 9 for the purpose of simplifying FIG. 9. A transfer mechanism or belt 90 is shown in FIG. 9 below the spray guns 82 and nozzle 24 which conveys can ends 10 below the spray guns 82 for application of fluid, repair fluid, lacquer or paint to the can ends 10. The can ends 10 are typically transferred to the transfer mechanism 90 by a downstacker or the like.

With reference to FIG. 7, apertures 84 are located on mounting brackets 92. The spray gun 82 is equipped with a manifold 94 for delivery of the fluid to spray head 16. Hoses (not shown) are coupled to connectors 96 for delivery of the fluid to the manifold 94. The hoses (not shown) are additionally secured to the spray gun 82 by connector assembly 98. As an example, connector assembly 98 is shown as a plurality of brackets coupled together.

Figure 10:
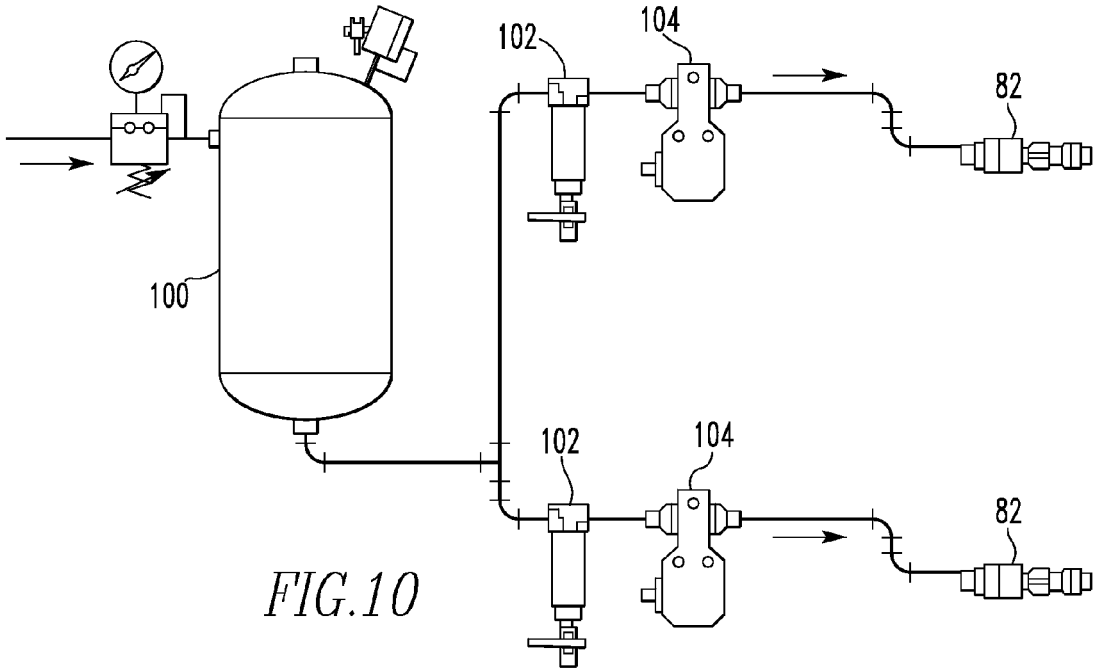
FIG. 10 is a schematic drawing of a low pressure solid stream or non-atomization spray method.

With reference to FIG. 10, the fluid delivery system of the present invention is a low pressure tank system. Fluid is supplied to a low pressure tank 100. Next, the tank 100 is pressurized using conventional compressed gas sources or the like which are typically less than 100 psi (0.690 MPa). The tank 100 does not require additional complicated amplification systems and equipment for flowing the fluid through the fluid delivery system. The fluid is then filtered through a fluid filter 102. The fluid then flows through a fluid flow sensor 104 which monitors and/or controls the flow rate of the fluid. The fluid flow sensor 104 allows the end-user to selectively control the flow rate of the fluid from the spray gun 82. By controlling the flow rate of the fluid from the spray gun 82, the end-user can control the amount or weight of fluid that is dispensed onto each can end 10. The fluid then flows to the rotating spray gun 82 attached to the spray machine 88 which is rotating in a circular pattern. The tank 100, the fluid filter 102, the fluid flow sensor 104 and the spray gun 82 are in fluid communication with one another and define a fluid delivery system. The fluid is dispensed from the nozzle 24 in a circular pattern in a solid stream from the nozzle 24 toward the can end 10. The circular pattern is concentrated and emitted with low pressure using conventional compressed gas sources which are typically less than 100 psi (0.690 MPa) without further amplification whereas the prior art spray head 18 emits the fluid in an elliptical and disperse pattern at a higher pressure which is typically greater than 100 psi (0.690 MPa). The circular and concentrated pattern of the present invention significantly reduces the problem associated with the overspray produced by spray head 18. The fluid is dispensed from the spray head 16 in a controlled manner due to the rigid bearing support system 30 of the present invention. The length that the fluid leaves nozzle 24 allows for a continuous circular vector of fluid without turbulence or fluid breakup as it leaves the nozzle 24. Dispensing the fluid from spray head 16 allows the fluid to be sprayed on the score line 12 of the can end 10 in low and high volumes and minimizes overspray that negatively effects the machine efficiency equipped with spray head 18.

The spray machine 88 has been omitted from FIG. 10 for the purpose of simplifying the FIG. The low pressure of this system minimizes the number of components that are wetted by the fluid which oftentimes consists of mixed epoxy coatings. Avoiding overspray is important to machine efficiency because it reduces the downtime of cleaning and maintaining the transfer mechanism, belts or other components of the machine.

The industry has not utilized this type of spraying method because it has not been provided as an option by the can machinery original equipment manufacturers ("OEMs") since the OEMs did not have appropriate spray head control technology of the rigid bearing support system 30 used in the present invention that implements the low pressure solid stream or non-atomization spray method. The apparatus and method of the present invention allows for the spray head to translate or rotate in a precise circular motion that places the spray pattern within approximately a ±0.050 inch (1.27 mm) radial band around the centerline of the score line 12. This precise motion allows the circular band to fully cover the score line 12 even though the band width is substantially smaller than the commonly used atomized fan pattern as is shown in FIG. 2.

Solid stream or non-atomization spraying is typically applied by dispensing the fluid through a nozzle 24 at a low pressure using conventional compressed gas sources which are typically less than 100 psi (0.690 MPa) whereas high pressure methods used in the droplet or atomization process generally use high pressure circulating fluid circuits at a pressure of between 100 psi (0.690 MPa) to 600 psi (4.137 MPa) or using a secondary low pressure air source of around 100 psi (0.690 MPa) with specialized pumps for the two part epoxy mixtures predominantly used as fluid in score repair. The low pressure solid stream spraying method uses less complicated fluid delivery systems. For example, the present invention uses the pressure pot system of FIG. 10 that minimizes the number of components wetted by the two part epoxy coatings.

The low pressure requirement for the solid stream spray head 16 greatly simplifies the fluid delivery method of the present invention. This is particularly important to machine efficiency because the two part epoxy coating mixtures used are difficult to manage because they usually have a finite pot life and the apparatus requires routine maintenance. The low pressure method of the present invention limits the number of wetted components in the apparatus. See FIG. 10.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereto.

What is claimed is:

1. A method for the repair of coating adhered on a can end, comprising:

supplying fluid to a low pressure tank;

filtering the fluid through a fluid filter;

flowing the fluid through a fluid flow sensor; and dispensing the fluid from one or more spray guns in a solid stream and in a continuous circular vector pattern toward the can end, wherein the low pressure tank, the fluid filter, the fluid flow sensor and the one or more spray guns are in fluid communication with one another which defines a fluid delivery system;

further comprising providing a spray apparatus, the spray apparatus comprising:

one or more elongated shafts rotatably coupled to a frame;

one or more bearing members rotatably coupled to the one or more elongated shafts;

one or more plates rotatably coupled to the one or more first bearing members; and said one or more spray guns fixedly coupled to the one or more plates, wherein the one or more spray guns apply said fluid to the can end with a solid stream being emitted from the one or more spray guns in a continuous circular vector pattern, wherein a plurality of can ends, a plurality of elongated shafts, a first plurality of bearing members, a plurality of plates and a plurality of spray guns are provided, wherein the one or more plates have a plurality of brackets; wherein the plurality of brackets are coupled to the one or more plates, wherein the one or each of the spray guns is/are fixedly coupled to a corresponding one of the plurality of brackets, and wherein each of the plurality of brackets extends laterally outwardly from a corresponding one of the one or more plates.

2. The method of claim 1, wherein the fluid is dispensed through the one or more spray guns at a relatively low pressure of less than 100 psi (0.690 MPa).

3. The method of claim 2, wherein the relatively low pressure is supplied from a compressed gas source.

4. The method of claim 1, wherein the fluid flow sensor selectively controls a flow rate of the fluid.

5. The method of claim 1, wherein the one or more spray guns is/are rotated in a circular pattern which places the fluid in approximately a +/−0.050 inch (1.27 mm) radial band around a centerline of a score line of the can end.

6. The method of claim 1, wherein the circular pattern of dispensing the fluid and low pressure substantially avoids dispensing fluid onto a transfer mechanism located below the one or more spray guns which would contaminate the transfer mechanism.

7. The method of claim 1, wherein each of the one or more spray guns moves with but not independently with respect to the corresponding one of the one or more plates to which it is mounted.

8. The method of claim 1, further comprising:

a second plurality of bearing members coupled to the frame, wherein the one or more elongated shafts pass through a portion of the second plurality of bearing members coupled to the frame.

9. The method of claim 1, wherein one of the shafts passes through an aperture of a first sprocket and the other one of the shafts passes through an aperture of a second sprocket.

10. The method of claim 9, further comprising a belt rotatably coupled to the sprockets.

11. The method of claim 10, further comprising a motor rotatably coupled to one of the shafts.

12. The method of claim 1, further comprising a transfer mechanism located below the one or more spray guns.

13. A method for the repair of coating adhered on a plurality of can ends, comprising:

providing a spray apparatus comprising:

a frame;

a first elongated shaft rotatably coupled to the frame;

a second elongated shaft rotatably coupled to the frame;

a third shaft coupled to the first elongated shaft which passes through an aperture in a first bearing member and a first plate;

a fourth shaft coupled to the second elongated shaft which passes through an aperture in a second bearing member and the first plate;

a fifth shaft coupled to the third shaft which passes through an aperture of a third bearing member and a second plate;

a sixth shaft coupled to the fourth shaft which passes through an aperture in a fourth bearing member and the second plate;

a first bracket coupled to the first plate;

a second bracket coupled to the second plate;

a first spray gun fixedly coupled to the first bracket; and a second spray gun fixedly coupled to the second bracket, and applying fluid to the can ends with a solid stream being emitted from the spray guns in a continuous circular vector pattern.

14. The method of claim 13, further comprising:

a plurality of fifth and sixth bearing members coupled to the frame, wherein the elongated first shaft passes through a portion of the fifth bearing members coupled to the frame and the elongated second shaft passes through a portion of the sixth bearing members coupled to the frame.

15. The method of claim 13, wherein the elongated first shaft passes through an aperture of a first sprocket and the elongated second shaft passing through an aperture of a second sprocket.

16. The method of claim 15, further comprising a belt rotatably coupled to the sprockets.

17. The method of claim 16, further comprising a motor rotatably coupled to the first elongated shaft.

18. The method of claim 13, further comprising a transfer mechanism located below the spray guns.

* * * * *